US012607091B2

(12) United States Patent
Awwami et al.

(10) Patent No.: US 12,607,091 B2
(45) Date of Patent: Apr. 21, 2026

(54) CURING CASING LEAK TOOL

(71) Applicant: SAUDI ARABIAN OIL COMPANY, Dhahran (SA)

(72) Inventors: Hashim A. Awwami, Dhahran (SA); Turki M. Balhareth, Al Khobar (SA); Hind M. Ghuwainem, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/651,446

(22) Filed: Apr. 30, 2024

(65) Prior Publication Data

US 2025/0334022 A1 Oct. 30, 2025

(51) Int. Cl.

| | |
|---|---|
| ***E21B 33/16*** | (2006.01) |
| ***E21B 29/10*** | (2006.01) |
| ***E21B 33/124*** | (2006.01) |
| ***E21B 33/13*** | (2006.01) |
| ***E21B 33/138*** | (2006.01) |

(Continued)

(52) U.S. Cl.

CPC ..... *E21B 33/16* (2013.01); *E21B 33/124* (2013.01); *E21B 33/13* (2013.01); *E21B 33/138* (2013.01); *E21B 34/142* (2020.05); *E21B 47/06* (2013.01); *E21B 47/117* (2020.05); *E21B 29/10* (2013.01); *E21B 2200/04* (2020.05)

(58) Field of Classification Search

CPC ..... E21B 33/16; E21B 47/117; E21B 34/142; E21B 33/124; E21B 33/13; E21B 33/138; E21B 47/06; E21B 2200/04; E21B 29/10

See application file for complete search history.

(56) References Cited

U.S. PATENT DOCUMENTS 2,251,977 A * 8/1941 Burt ..... E21B 33/146 166/156
2,762,440 A * 9/1956 Reed ..... E21B 34/142 166/290

(Continued)

FOREIGN PATENT DOCUMENTS

| | | |
|---|---|---|
| CN | 101608538 A | 12/2009 |
| CN | 102140900 A | 8/2011 |
| CN | 112012667 A | 12/2020 |

OTHER PUBLICATIONS

BiSN, "Repair Damaged Tubing / Casing (CLS)"; <https://bisn.com/applications/well-intervention/repair-damaged-tubing-casing/>; Accessed Apr. 29, 2024 (6 pages).

*Primary Examiner* — Neel Girish Patel
(74) *Attorney, Agent, or Firm* — Osha Bergman Watanabe & Burton LLP

(57) ABSTRACT

A system includes a plug and a tool. The plug is configured to perform one or more pressure tests within the tubular to determine a location of the leak. The tool includes an upper isolation packer, a lower isolation packer, a lower ball valve, an upper ball valve, and drillable tubulars. The upper isolation packer is located up hole from the location of the leak and is configured to seal against an inner surface of the tubular. The lower isolation packer is located downhole from the location of the leak and is configured to seal against the inner surface of the tubular. The lower ball valve is configured to allow the upper isolation packer and the lower isolation packer to seal against the inner surface of the tubular. The upper ball valve is configured to deploy cement into the leak to repair the leak.

20 Claims, 12 Drawing Sheets

(51) Int. Cl.

| | |
|---|---|
| ***E21B 34/14*** | (2006.01) |
| ***E21B 47/06*** | (2012.01) |
| ***E21B 47/117*** | (2012.01) |

(56) References Cited

U.S. PATENT DOCUMENTS

| | | | | |
|---|---|---|---|---|
| RE42,877 | E * | 11/2011 | Lirette | E21B 33/14 175/57 |
| 9,359,858 | B2 * | 6/2016 | Themig | E21B 33/124 |
| 10,280,706 | B1 | 5/2019 | Sharp, III | |
| 11,255,154 | B2 | 2/2022 | Fagna et al. | |
| 11,391,113 | B2 | 7/2022 | Al-Mousa et al. | |
| 11,473,397 | B2 | 10/2022 | Egbe et al. | |
| 2011/0100643 | A1 * | 5/2011 | Themig | E21B 34/10 166/321 |
| 2013/0233572 | A1 * | 9/2013 | Helms | E21B 33/146 166/387 |
| 2014/0262290 | A1 * | 9/2014 | Bussear | E21B 34/14 166/305.1 |
| 2015/0129218 | A1 * | 5/2015 | Wright | E21B 43/14 166/387 |
| 2016/0024877 | A1 * | 1/2016 | Coronado | E21B 34/10 166/177.4 |
| 2019/0153810 | A1 * | 5/2019 | Cervo | E21B 33/14 |
| 2019/0323343 | A1 * | 10/2019 | Egbe | E21B 33/124 |
| 2020/0056446 | A1 * | 2/2020 | Al-Mousa | E21B 33/1293 |
| 2021/0010345 | A1 * | 1/2021 | Acosta | E21B 33/146 |
| 2021/0025259 | A1 * | 1/2021 | Al-Mousa | E21B 33/138 |
| 2021/0054708 | A1 * | 2/2021 | Al-Mousa | E21B 33/134 |
| 2022/0010651 | A1 * | 1/2022 | Egbe | E21B 34/142 |
| 2024/0084668 | A1 * | 3/2024 | Al-Ghamdi | E21B 34/142 |
| 2024/0093572 | A1 * | 3/2024 | Al-Mousa | E21B 34/142 |

* cited by examiner

CURING CASING LEAK TOOL

BACKGROUND

Hydrocarbons are located in porous rock formations beneath the Earth's surface. Wells are drilled into these formations to access and produce the hydrocarbons. In order to protect people and the environment, wells are created by drilling a wellbore into the Earth and casing the wellbore using a casing string. Depending on the depth of the formation, multiple sections of a wellbore having different diameters may be drilled, and concentrically-placed casing strings may case each wellbore section.

Casing strings have many purposes, including isolating the internal environment of the well from an external environment of the well, isolating various formations from one another (such as isolating a hydrocarbon-bearing formation from freshwater-bearing formation), and providing a controlled conduit for hydrocarbons to migrate to the surface. A casing string may experience leaks at any point in its life cycle. When a leak occurs in a casing string, the integrity of the well is damaged, and the leak must be repaired to protect people and the environment and to continue wellbore operations.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments methods and systems for repairing a leak in a tubular located in a well. The system includes a plug and a tool. The plug is configured to perform one or more pressure tests within the tubular to determine a location of the leak. The tool includes an upper isolation packer, a lower isolation packer, a lower ball valve, an upper ball valve, and drillable tubulars. The upper isolation packer is located up hole from the location of the leak and is configured to seal against an inner surface of the tubular. The lower isolation packer is located downhole from the location of the leak and is configured to seal against the inner surface of the tubular. The lower ball valve is located downhole from the lower isolation packer and is configured to allow the upper isolation packer and the lower isolation packer to seal against the inner surface of the tubular. The upper ball valve is located between the upper isolation packer and the lower isolation packer and is configured to deploy cement into the leak to repair the leak. The drillable tubulars connect the upper isolation packer, the lower isolation packer, the lower ball valve, and the upper ball valve to one another. The drillable tubulars, the upper isolation packer, the lower isolation packer, the lower ball valve, and the upper ball valve are made of drillable material.

The method includes determining a location of the leak in the well by performing one or more pressure tests within the tubular using a plug, making up a tool comprising an upper isolation packer, a lower isolation packer, a lower ball valve, an upper ball valve, and drillable tubulars, based on the location of the leak, and deploying the tool into the well. The method also includes setting the upper isolation packer up hole from the leak and the lower isolation packer downhole from the leak to seal the upper isolation packer and the lower isolation packer against an inner surface of the tubular using the lower ball valve, deploying cement into the leak using the upper ball valve to repair the leak, and drilling out the tool.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
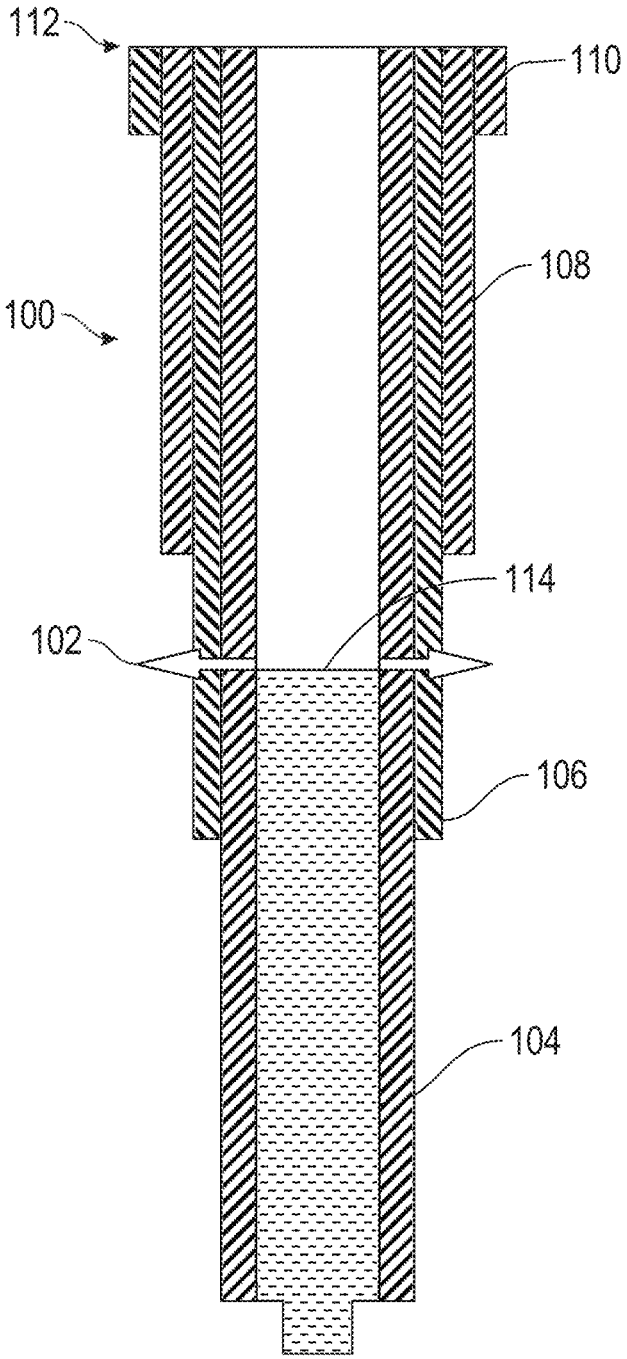
FIG. 1 shows a well having a leak in accordance with one or more embodiments.

FIG. 1 shows a well (100) having a leak (102) in accordance with one or more embodiments. The well (100) shown is for example purposes only and a person skilled in the art will appreciate that any well having any type of wellbore trajectory, wellbore schematic, or well/equipment design may be used without departing from the scope of the disclosure herein. For example, the well (100) shown in FIG.

1 has four sets of casing strings; however, any well having at least one casing string that is experiencing a leak (102) may be used.

The well (100) shown in FIG. 1 has four casing strings: a production casing string (104), an intermediate casing string (106), a surface casing string (108), and a conductor casing string (110). The casing strings (104, 106, 108, 110) extend from the surface (112) into the Earth and are cemented within the well (100). The surface (112) may be any location on or above the Earth's surface, including a cellar or depression formed into the Earth's surface. Moreover, the casing strings (104, 106, 108, 110) may have any suitable inner/outer diameter and length known in the art.

The casing strings (104, 106, 108, 110) may be made out of any material known in the art, such as a steel alloy. All of the casing strings (104, 106, 108, 110) are comprised of one or more tubulars connected to one another. The casing strings (104, 106, 108, 110) may have varying lengths, inner diameters, and outer diameters, when compared to one another.

In accordance with one or more embodiments, the conductor casing string (110) is the outer-most and shallowest-set casing string, which may be used to prevent the top of the well (100) from caving in and help circulate fluid.

In accordance with one or more embodiments, the surface casing string (108) is nested inside the conductor casing string (110). The surface casing string (108) may be used to isolate freshwater formations from deeper hydrocarbon formations such that hydrocarbons are prevented from contaminating water resources.

In accordance with one or more embodiments, the intermediate casing string (106) is nested within the surface casing string (108). The intermediate casing string (106) may be used to support deeper wells and isolate varying wellbore pressures.

In accordance with one or more embodiments, the production casing string (104) is nested within the intermediate casing string (106). The production casing string (104) is the deepest-set and inner-most casing string. The production casing string (104) may be used to provide a conduit for deploying production tubing and other production equipment into the well (100).

FIG. 1 shows the production casing string (104) having a leak (102). The leak (102) causes the fluid located within the well (100) to migrate out of the well (100) into surrounding formations. As such, the fluid height (114) in the well (100) has lowered. The fluid in the well (100) may be any wellbore fluid known in the art, such as drilling mud, completion fluid, brine, production fluid, etc. It is important the leak (102) is repaired because the fluid located in the well (100) may contaminate downhole formations, or the reduction of fluid height in the well (100) may create pressure control situations that may lead to a kick or a blowout.

Conventional methods of repairing casing leaks require multiple trips into the well (100) which takes time and extends the window in which wellbore incidents, such as kicks and blowouts, may occur. Therefore, methods and systems that repair the leak (102) in a reduced number of trips in the well (100) is beneficial. As such, the present disclosure outlines a curing casing leak tool (CCLT) that is able to fix the leak (102) in a single trip after a pressure test has been performed on the well (100) to determine the depth of the leak (102).

Figure 2A:
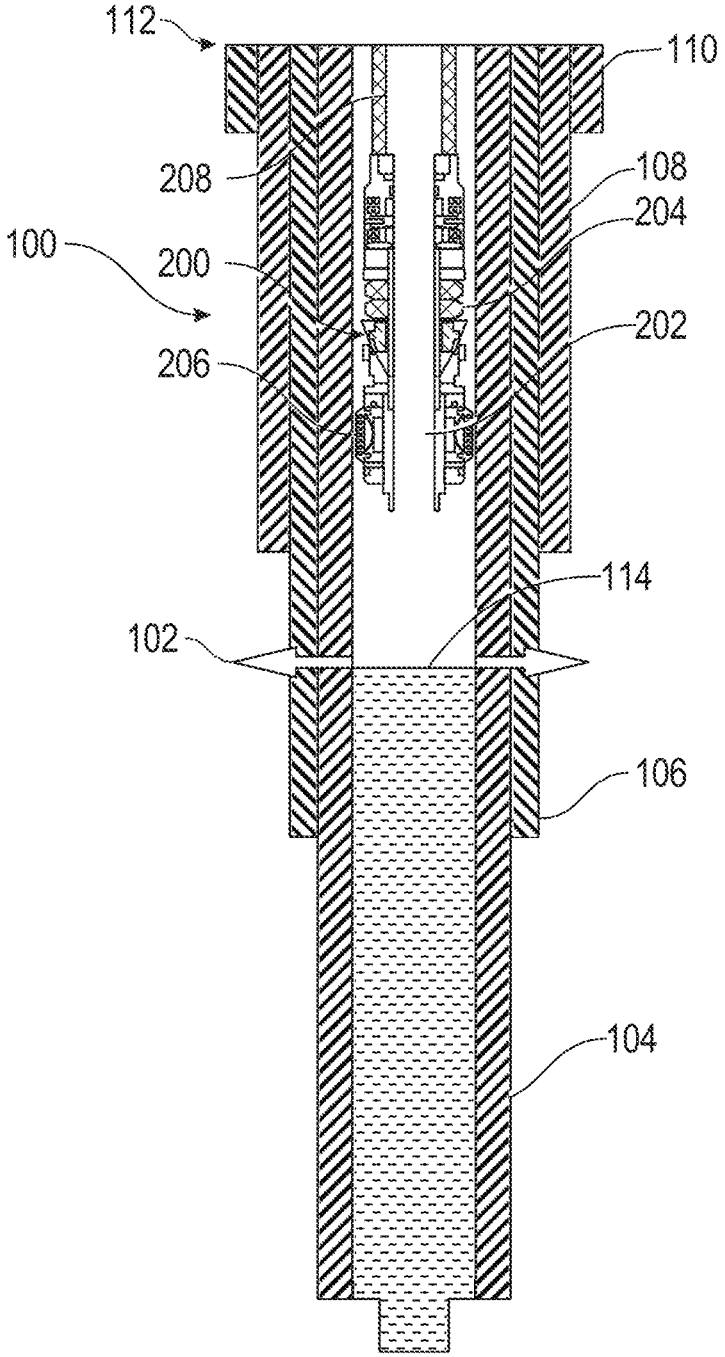
FIGS. 2*a*-2*b* show a pressure test being performed on the well using a plug to determine the depth of the leak in accordance with one or more embodiments.
Figure 2B:
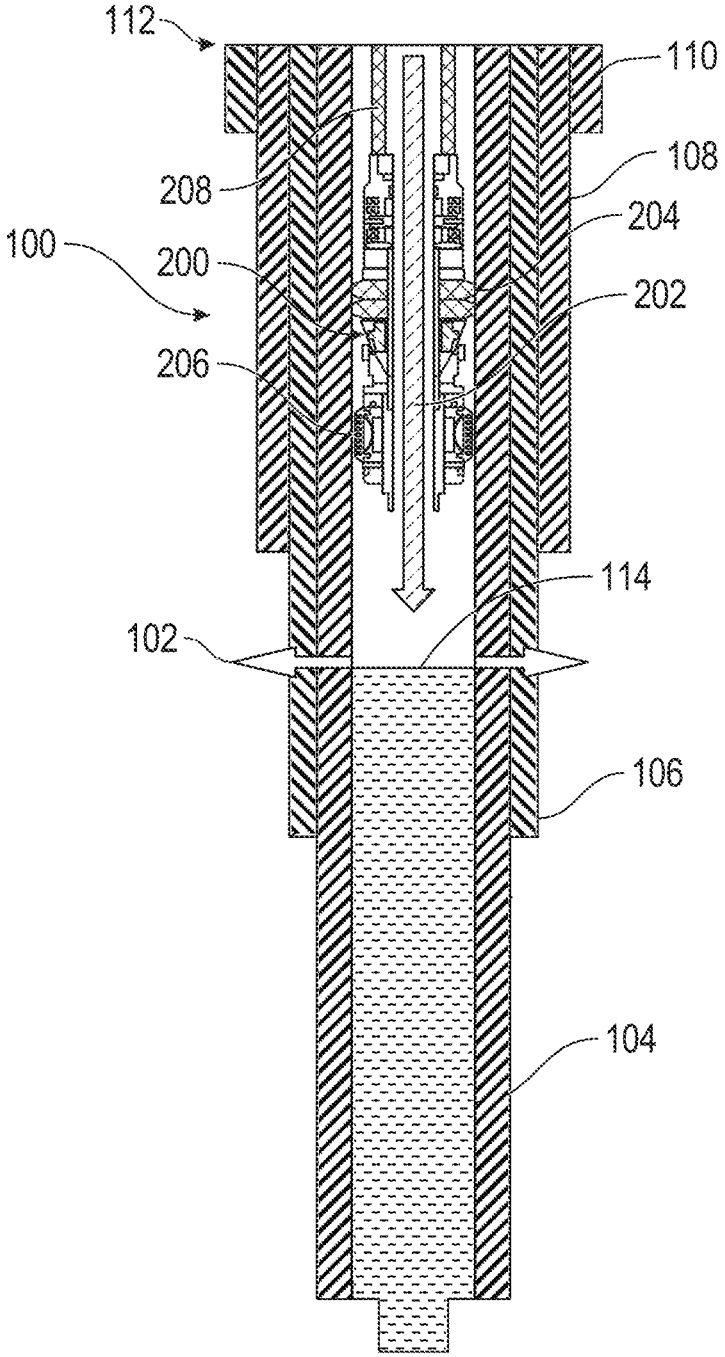

FIGS. 2*a*-2*b* show a pressure test being performed on the well (100) using a plug (200) to determine the depth of the leak (102) in accordance with one or more embodiments. FIG. 2*a* shows the plug (200) in an unsealed position and FIG. 2*b* shows the plug in a sealed position. The plug (200) has a plug conduit (202), a plug packer (204), and a set of slips (206).

The plug (200) is run into the well (100) on a tubular capable of conveying fluid into the plug (200), such as drill pipe (208). Drill pipe (208) may be metallic tubulars threaded to one another. In accordance with one or more embodiments, the plug (200) is designed to isolate various areas within the production casing string (104) to determine the location of a suspected leak (102).

In accordance with one or more embodiments, a leak (102) may be suspected during drilling operations when a fluid/pressure loss is detected. In production operations, a leak (102) may be suspected when there is an unexpended decrease in production.

Regardless of the method of detection, when a leak (102) is suspected, the plug (200) may be lowered into the well (100), as shown in FIG. 2*a*, on the drill pipe (208). Once the plug (200) is at a pre-determined depth, the pressure test is run.

The pressure test may include engaging the slips (206) into the inner surface of the production casing string (104) and expanding the plug packer (204) to seal against the inner surface of the production casing string (104). In accordance with one or more embodiments, the slips (206) and the plug packer (204) are activated by rotating the drill pipe (208) at the surface (112) and slacking off the drill pipe (208).

Once the slips (206) are engaged and the plug packer (204) is expanded, as shown in FIG. 2*b*, a fluid is pumped through the drill pipe (208), through the plug conduit (202), and into an interior of the production casing string (104). Once the pressure test is completed, the slips (206) are disengaged and the plug packer (204) is unexpanded so the plug (200) can be moved within the production casing string (104).

If the plug (200) is located below the leak (102), the pressure should build during the pressure test as fluid is pumped into the well (100). If the plug (200) is located above the leak (102) during the pressure test, the fluid will migrate into the leak (102). Thus, if the plug (200) is located above the leak (102), the pressure will not build, or will not build as much as it would if there were no leak (102).

Moreover, the pressure test can be performed at various depth intervals until the depth of the leak (102) is determined. Once the depth of the leak (102) is determined, the plug (200) may be removed from the well (100) and the CCLT (300) can be run into the well (100) to repair the leak (102).

Figure 3:
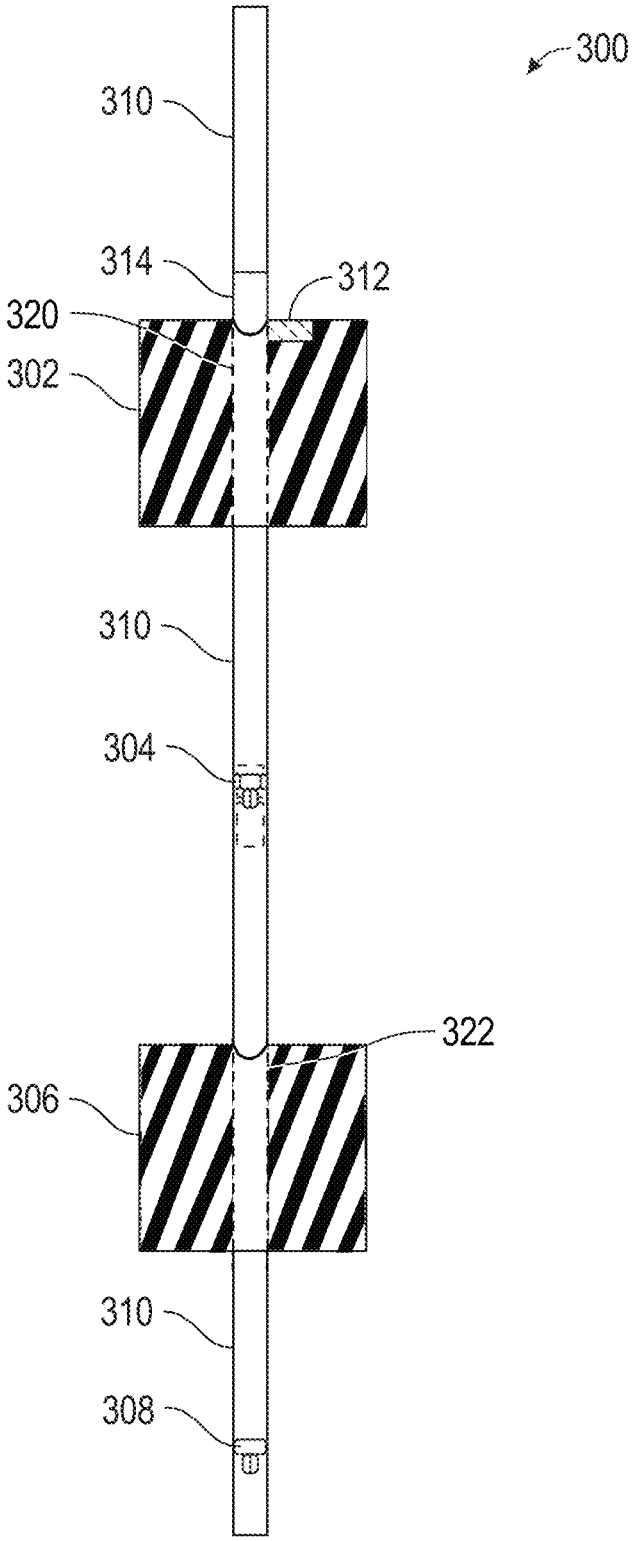
FIG. 3 show a Curing Casing Leak Tool (CCLT) in accordance with one or more embodiments.

FIG. 3 shows the CCLT (300) in accordance with one or more embodiments. The CCLT includes an upper isolation packer (302), an upper ball valve (304), a lower isolation packer (306), and a lower ball valve (308). These components are connected to one another using a series of drillable tubulars (310).

The drillable tubulars (310) may include non-metallic drill pipes that are tubular joints made of a non-metallic drillable material, such as Amine Cured Glass Reinforced Epoxy. The drillable tubulars (310) may be connected to one another and to the other components of the CCLT (300) using any connection means known in the art, such as threaded connections, bolted connections, welded connections, etc.

The upper isolation packer (302) and the lower isolation packer (306) are used to seal off portions of the well (100) from one another by sealing against an interior surface of a tubular, such as the production casing string (104). This is shown in greater detail in FIGS. 6*a*-6*d*. The upper isolation packer (302) and the lower isolation packer (306) may be any type of packer known in the art, such as mechanical or hydraulic packers. The drillable tubulars (310) may pass through the upper isolation packer (302) via a first through-bore (320) and pass through the lower isolation packer (306) via a second through-bore (322).

In accordance with one or more embodiments, the upper isolation packer (302) includes a sliding valve (312)/disconnect sub that allows a cement stinger (314) to sting into and out of the upper isolation packer (302). The cement stinger (314) may be a conventional cement stinger connected to drill pipe (208) as is used in conventional cement stinging operations. In other embodiments, the cement stinger (314) may also be made out of the same drillable material as the drillable tubulars (310) and run into the well (100) via drillable tubulars (310) or drill pipe (208).

The upper isolation packer (302) and the lower isolation packer (306) may be made out of a drillable material. For example, the expandable portions of the upper isolation packer (302) and the lower isolation packer (306) may be made out of rubber and the non-expandable portions may be made out of brass.

The upper isolation packer (302) and the lower isolation packer (306) are set by applying a pre-determined pressure against the lower ball valve (308). The pre-determined pressure causes the expandable portions of the upper isolation packer (302) and the lower isolation packer (306) to inflate and seal against the inner wall of the production casing string (104).

Figure 4:
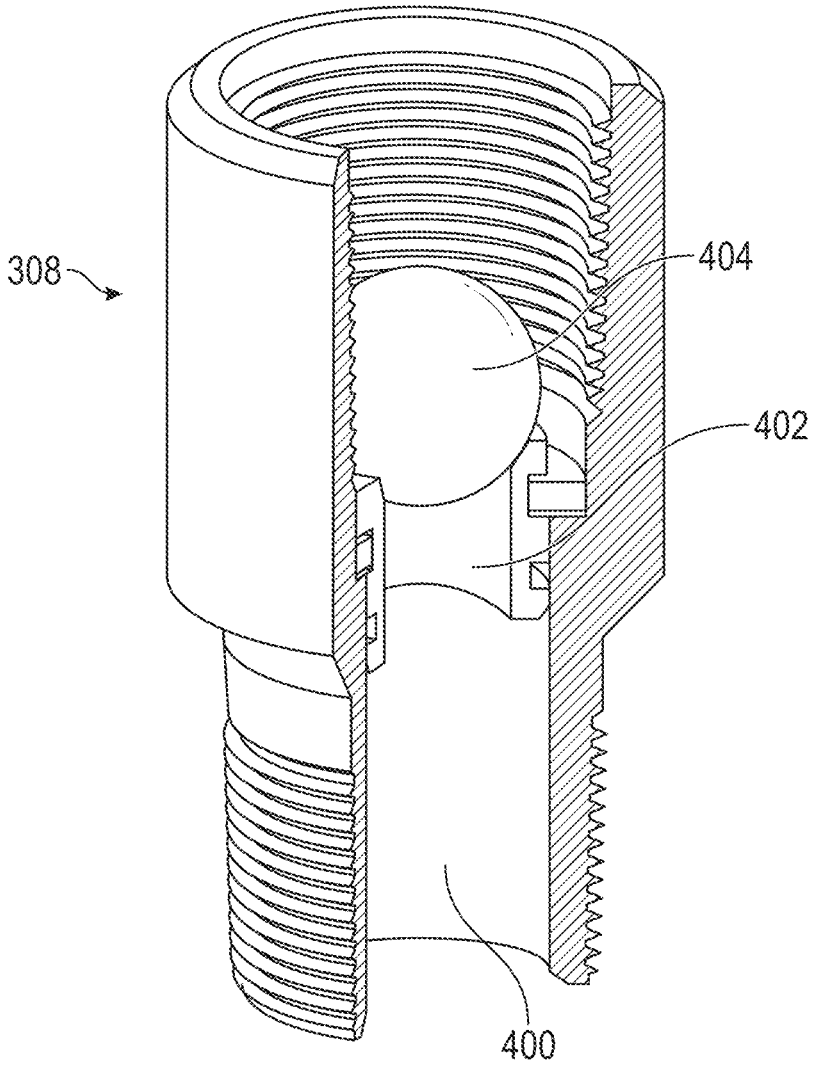
FIG. 4 shows a cut-away view of a lower ball valve in accordance with one or more embodiments.

FIG. 4 shows a cut-away view of the lower ball valve (308) in accordance with one or more embodiments. The lower ball valve (308) is a tubular having a lower ball valve conduit (400) extending therein. A lower ball seat (402) is located within the lower ball valve conduit (400).

A lower ball (404) is configured to be dropped into the lower ball valve conduit (400) and land on the lower ball seat (402). Once the lower ball (404) lands in the lower ball seat (402), the lower ball valve conduit (400) is blocked, and fluid can be pumped on top of the lower ball (404) to build pressure up hole from the lower ball valve (308). This pressure may be used to set the upper isolation packer (302) and the lower isolation packer (306).

In accordance with one or more embodiments, the body of the lower ball valve (308), the lower ball seat (402), and the lower ball (404) may be made out of a drillable material, such as brass, Amine Cured Glass Reinforced Epoxy, etc. As shown in FIG. 3, the lower ball valve (308) is connected between two neighboring joints of drillable tubular (310) and is located below, i.e., downhole from, the lower isolation packer (306). The lower ball valve (308) is connected between two neighboring joints of drillable tubular (310) using any connection means known in the art, such as a threaded connection.

FIGS. 5*a*-5*e* show various views of the upper ball valve (304) in accordance with one or more embodiments. The upper ball valve (304) is a tubular and comprises a sliding sleeve (500). Components of the upper ball valve (304) may be made out of a drillable material, such as brass, Amine Cured Glass Reinforced Epoxy, etc.

The sliding sleeve (500) is located inside the tubular and has an upper position and a lower position. In the upper position, the sliding sleeve (500) is blocking circulating ports (502), as shown in FIGS. 5*a*-5*d*. The sliding sleeve (500) is held in the upper position using one or more shear pins (504). The shear pins (504) may be located anywhere along the sliding sleeve (500) between the sliding sleeve (500) and the body of the upper ball valve (304). The shear pins (504) are configured to shear when a pre-determined pressure is applied across the shear pins (504).

Figure 5C:
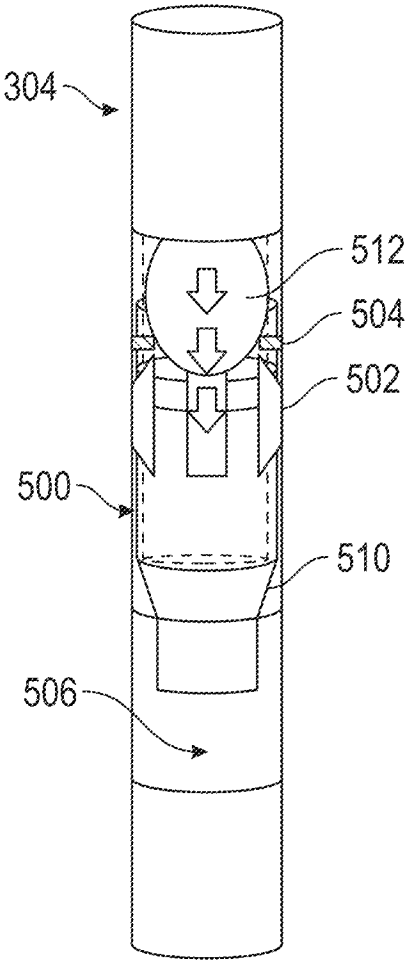
FIGS. 5*a*-5*e* show various views of an upper ball valve in accordance with one or more embodiments.
Figure 5B:
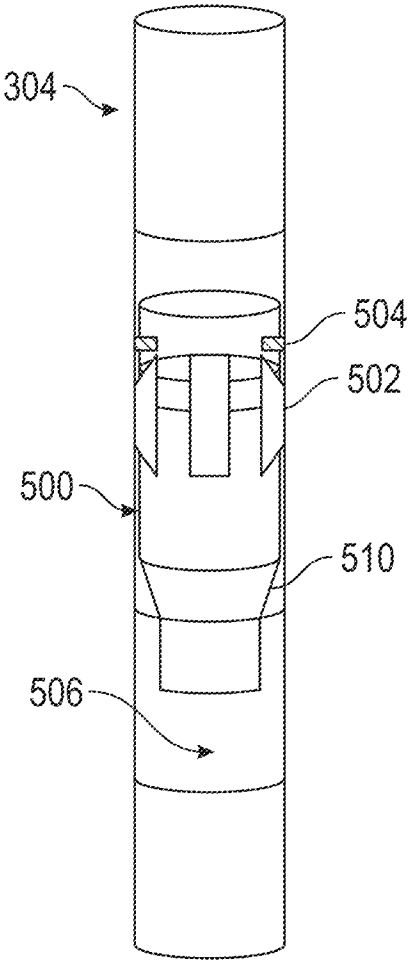
Figure 5A:
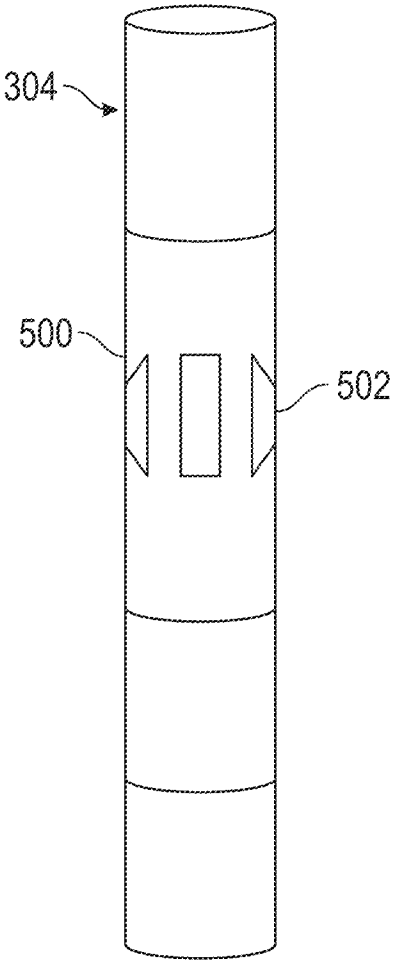
Figure 5E:
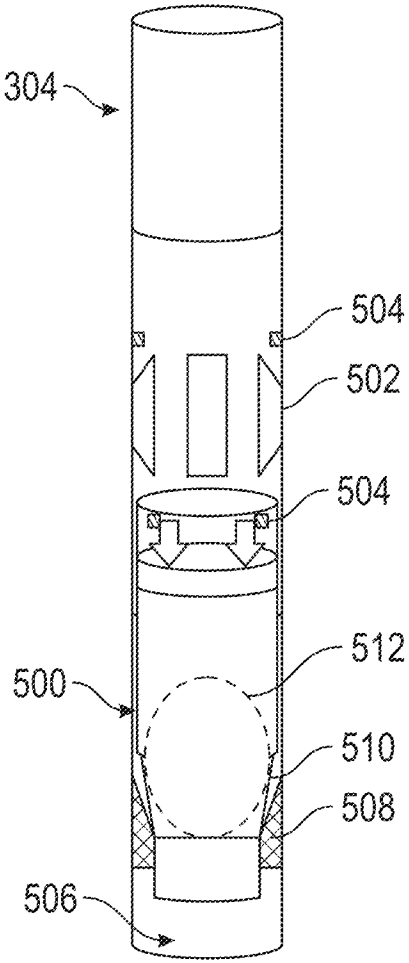

In the lower position, the sliding sleeve (500) is uncovering the circulating ports (502), as shown in FIG. 5*e*. The sliding sleeve (500) is placed in the lower position when the shear pins (504) are sheared, and the sliding sleeve (500) is pushed in a downhole direction using fluid pressure. When the sliding sleeve (500) is in the lower position, the circulating ports (502) are able to create hydraulic communication between an external environment of the upper ball valve (304) and an upper ball valve conduit (506) within the upper ball valve (304).

The sliding sleeve (500) is held in the lower position using a lock mechanism (508). The lock mechanism (508) may be a lock mandrel, locking dogs, a lock ring, etc. In accordance with one or more embodiments, the lock mechanism (508) may by a lock ring and may include a groove on the interior surface of the upper ball valve (304) and a ring on the exterior surface of the sliding sleeve (500). The ring may be compressed into the sliding sleeve (500) until the ring approaches the groove. As the ring approached the groove, the ring may jut out from the sliding sleeve (500) to lock into the groove of the upper ball valve (304).

The upper ball valve conduit (506) extends through both the upper ball valve (304) and the sliding sleeve (500). An upper ball seat (510) is located in the sliding sleeve (500) within the upper ball valve conduit (506). An upper ball (512) is configured to be dropped into the upper ball valve conduit (506) and land on the upper ball seat (510).

Once the upper ball (512) lands on the upper ball seat (510), the upper ball (512) blocks the upper ball valve conduit (506), and pressure may build up hole from the upper ball (512) when fluid is pumped downhole. When pressure builds on the upper ball (512), the pressure shears the shear pins (504) and pushes the sliding sleeve (500) in a downhole direction to uncover the circulating ports (502) and place the sliding sleeve (500) in the lower position.

FIG. 5*a* shows an external view of the upper ball valve (304) with the sliding sleeve in the upper position. The circulating ports (502) are machined into the wall/body of the upper ball valve (304). The sliding sleeve (500) is shown in the upper position and is blocking the circulating ports (502).

FIG. 5*b* shows an operational schematic of the upper ball valve (304). Specifically, FIG. 5*b* shows the sliding sleeve (500) in the upper position, covering the circulating ports (502).

FIG. 5*c* shows the upper ball (512) being dropped into the upper ball valve conduit (506).

Figure 5D:
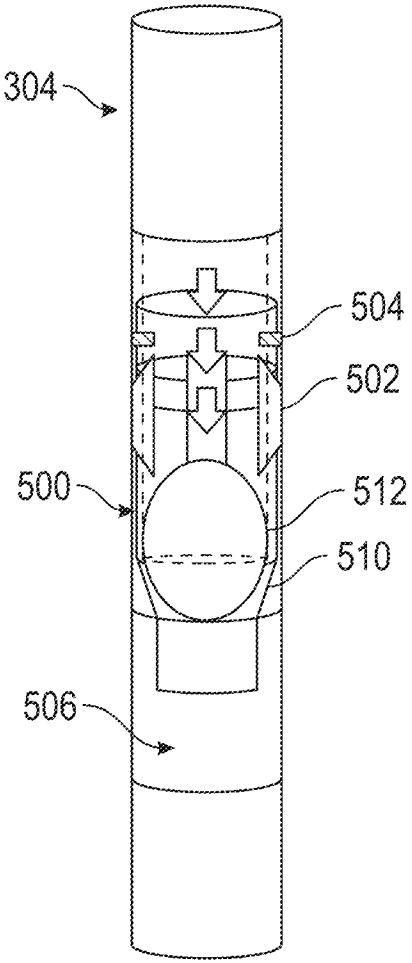

FIG. 5*d* shows the upper ball (512) landed out onto the upper ball seat (510) and pressure accumulating on top of the upper ball (512).

FIG. 5*e* shows the sliding sleeve (500) in the lower position, uncovering the circulating ports (502). The sliding sleeve (500) is placed in the lower position shown in FIG. 5*e* when the pressure accumulating on top of the upper ball (512) is sufficient to shear the shear pins (504) and push the sliding sleeve (500) downhole within the upper ball valve (304). At this point, the hydraulic communication exist between the upper ball valve conduit (506) and an external environment of the upper ball valve (304).

As shown in FIG. 3, the upper ball valve (304) is connected between two neighboring joints of drillable tubular (310) and is located below (i.e., downhole from) the upper isolation packer (302) and above (i.e., up hole from) the lower isolation packer (306). The upper ball valve (304) is connected between two neighboring joints of drillable tubular (310) using any connection means known in the art, such as a threaded connection.

FIGS. 6*a*-6*d* show the CCLT (300) being used to repair the leak (102) in accordance with one or more embodiments. Components shown FIGS. 6*a*-6*d* that are the same as or similar to components shown in FIGS. 1-5*e* have not be re-described for purposes of readability and have the same description and function as outlined above.

Figure 6A:
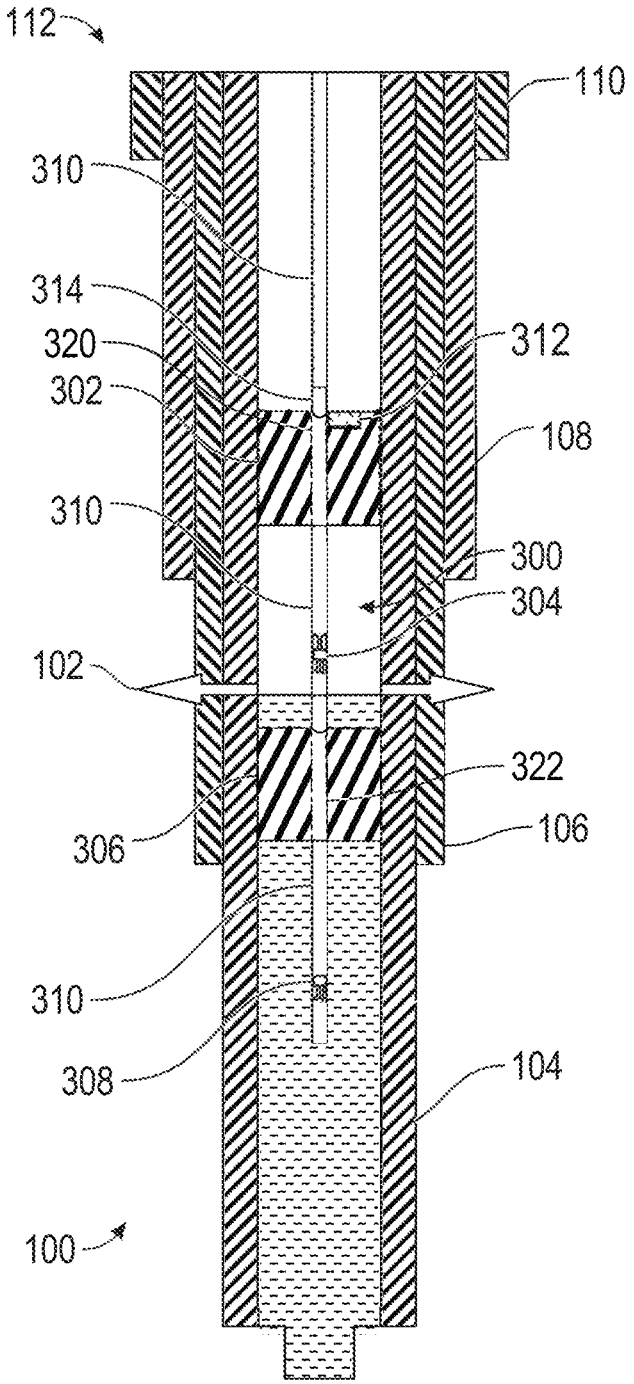
FIGS. 6*a*-6*d* show the CCLT being used to repair the leak in accordance with one or more embodiments.

FIG. 6*a* shows the CCLT (300) run to the required setting depth within the well (100). The required setting depth is determined based off of the pressure testing performed using the plug (200) as outlined in FIGS. 2*a*-2*b*. Specifically, the upper ball valve (304) is placed proximate the leak (102) and the upper isolation packer (302) and the lower isolation packer (306) are placed up hole and downhole from the leak (102), respectively. The upper isolation packer (302) and the lower isolation packer (306) are set in place using the lower ball valve (308).

Specifically, the upper isolation packer (302) and the lower isolation packer (306) are set by dropping the lower ball (404) into the lower ball valve (308). The lower ball (404) is of a smaller outer diameter than the inner diameter of the upper ball seat (510) so that the lower ball (404) may pass through the upper ball valve (304) to land out in the lower ball valve (308). A pre-determined fluid pressure (e.g., 1000 pounds per square inch (psi)) is applied to the CCLT (300) by pumping a fluid from the surface (112) onto the lower ball (404) located in the lower ball seat (402) to activate both the upper isolation packer (302) and the lower isolation packer (306).

The upper isolation packer (302) and the lower isolation packer (306) are activated to seal the space located between the upper isolation packer (302) and the lower isolation packer (306) from the portion of the well (100) located up hole from the upper isolation packer (302) and from the portion of the well (100) located downhole from the lower isolation packer (306). The setting of the upper isolation packer (302) and the lower isolation packer (306) may be confirmed by bleeding off pressure and pressure testing the backside and string tensions.

Figure 6B:
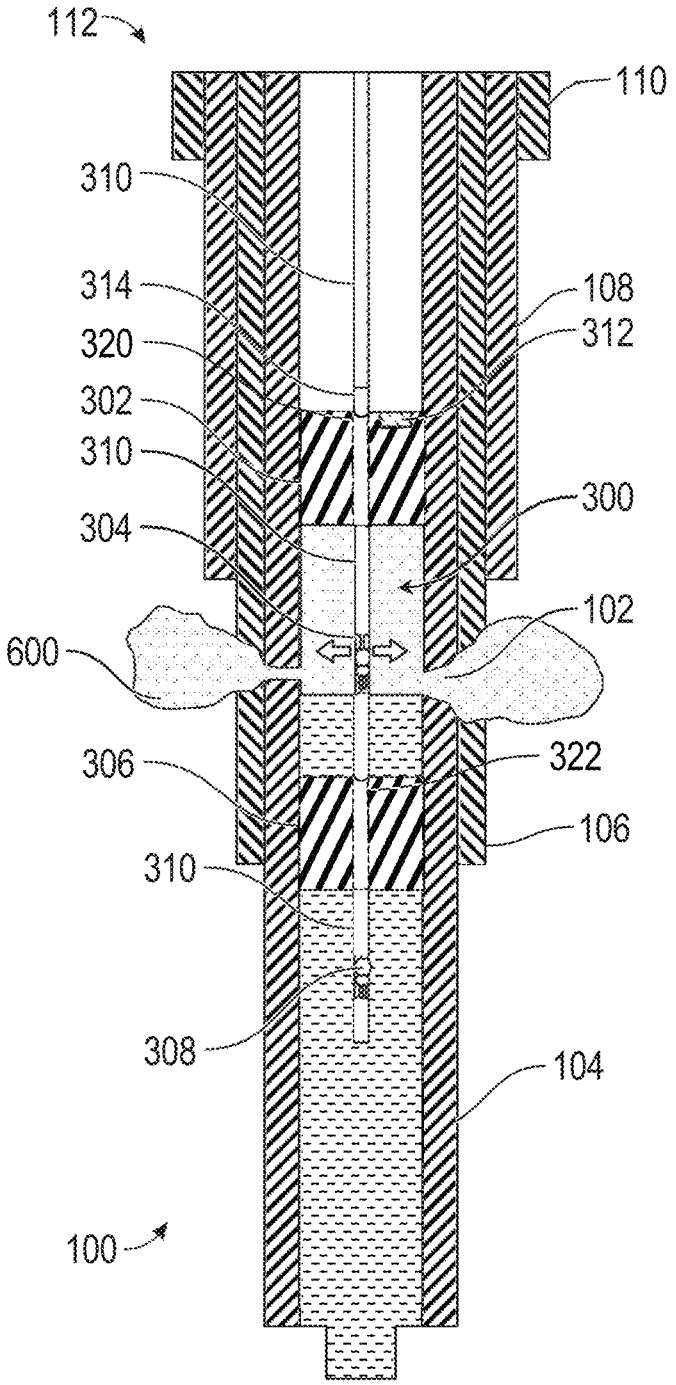

FIG. 6*b* shows cement (600) being pumped into the leak (102) using the CCLT (300). The cement (600) is able to be pumped into the leak (102) when the circulating ports (502) on the upper ball valve (304) are exposed. The circulating ports (502) are exposed by dropping the upper ball (512) into the upper ball valve (304) and applying the second predetermined pressure, as shown in FIGS. 5*a*-5*e*.

Once the upper ball (512) is landed onto the upper ball seat (510), a pre-determined pressure (e.g., 1400 psi) is applied to the CCLT (300) by pumping a fluid from the surface (112) onto the upper ball (512) located in the upper ball seat (510). The pre-determined pressure causes the shear pins (504) to shear and pushes the sliding sleeve (500) downhole to uncover the circulating ports (502). The uncovering of the circulating ports (502) may be confirmed by increasing the pressure to pumping pressure and performing an injectivity test. In accordance with one or more embodiments, the pre-determined pressure that causes the shear pins (504) to shear is larger than the pre-determined pressure required to activate the upper isolation plug (200) and the lower isolation plug (200) to seal against the inner surface of the production casing string (104).

Once the injectivity test is performed and it is confirmed all valves and ports are opened, cement (600) is pumped into the leak (102). Specifically, the cement (600) is pumped from the surface (112) through the cement stinger (314), through the upper isolation packer (302), through the drillable tubulars (310), out of the circulating ports (502), into the space between the upper isolation packer (302) and the lower isolation packer (306), through the leak (102), and into the surrounding formation. Once the cement job is completed and the pre-determined lock up pressure is achieved, pressure is maintained for a period of time to confirm locking.

Figure 6C:
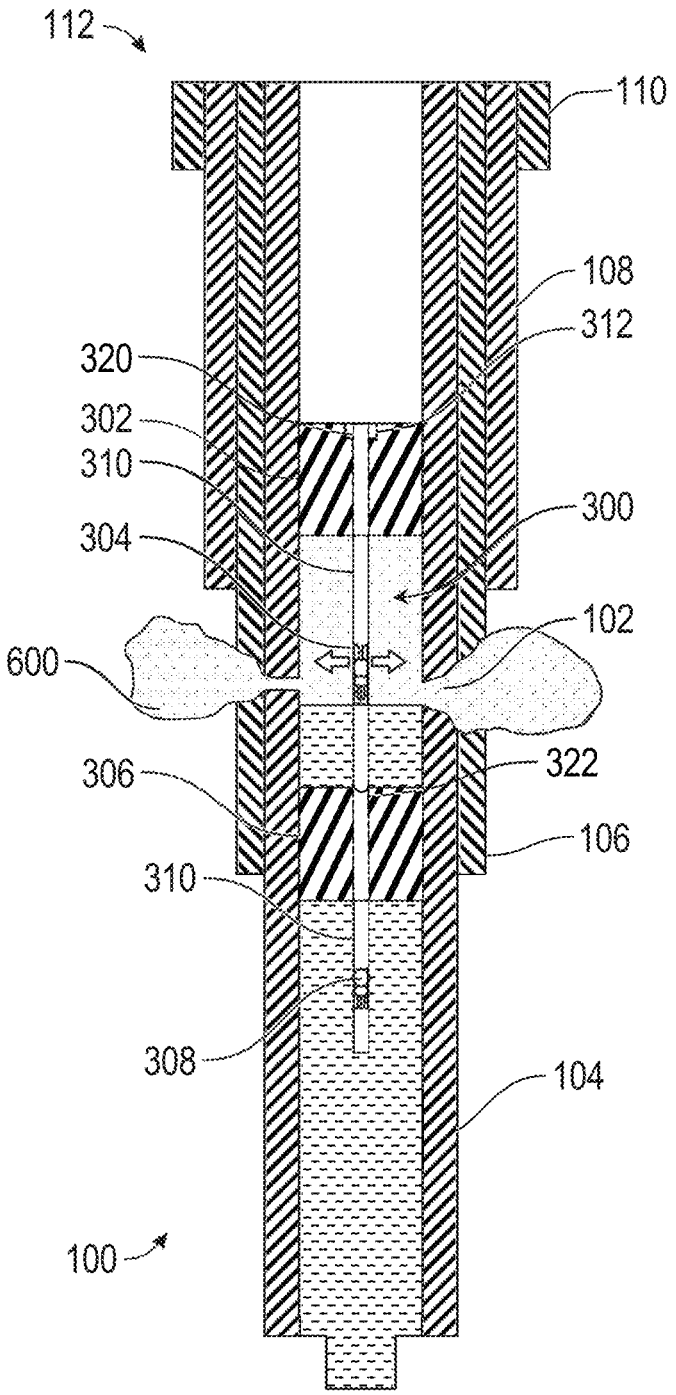

FIG. 6*c* shows the CCLT (300) after the cement stinger (314) has been un-stung from the upper isolation packer (302). After the cement job is completed, the cement stinger (314) is un-stung from the upper isolation packer (302) and removed from the well (100). At this point, the system is left alone for a pre-determined amount of time to allow the cement (600) to set.

Figure 6D:
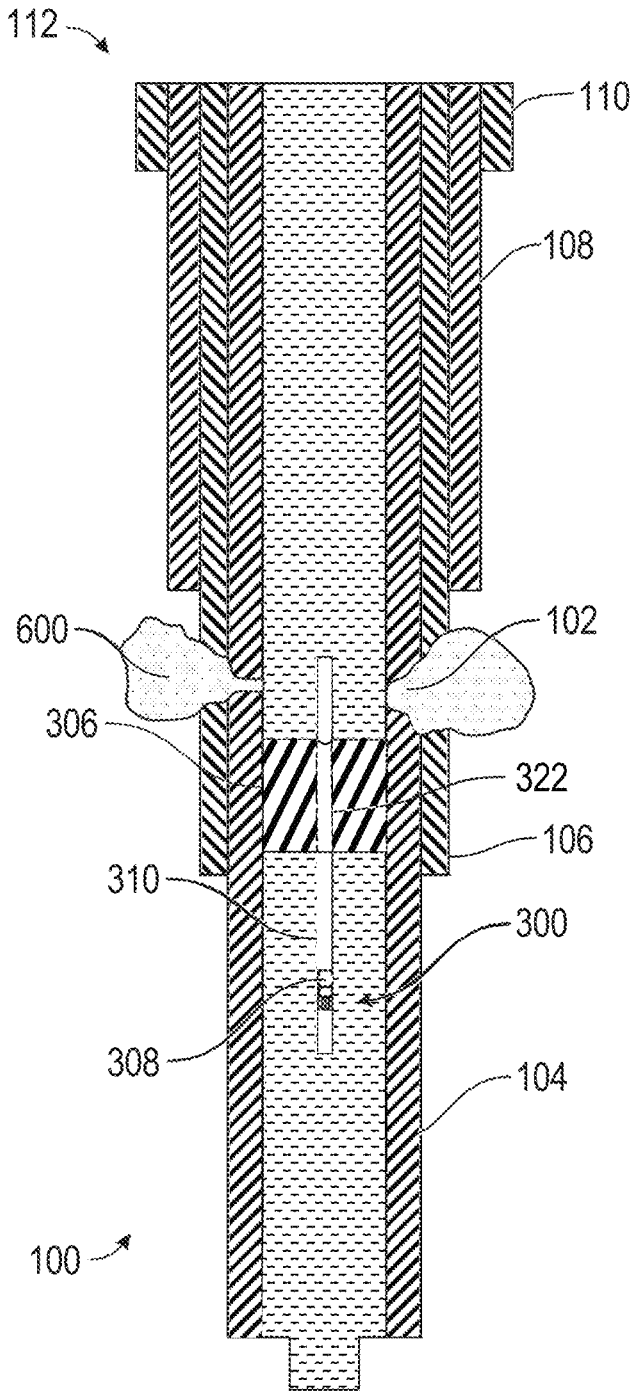

Once the cement (600) has set, a drill string may be ruin in hole and the portion of the CCLT (300) located up hole from the lower isolation packer (306) is drilled out. FIG. 6*d* shows the portion of the CCLT (300) located up hole from the lower isolation packer (306) drilled out. At this time, a pressure test may be performed against the lower isolation packer (306) to confirm the leak (102) has been repaired. If the pressure test fails, a subsequent remedial job may need to be performed. If the pressure test is successful, the remainder of the CCLT (300) may be drilled out.

Figure 7:
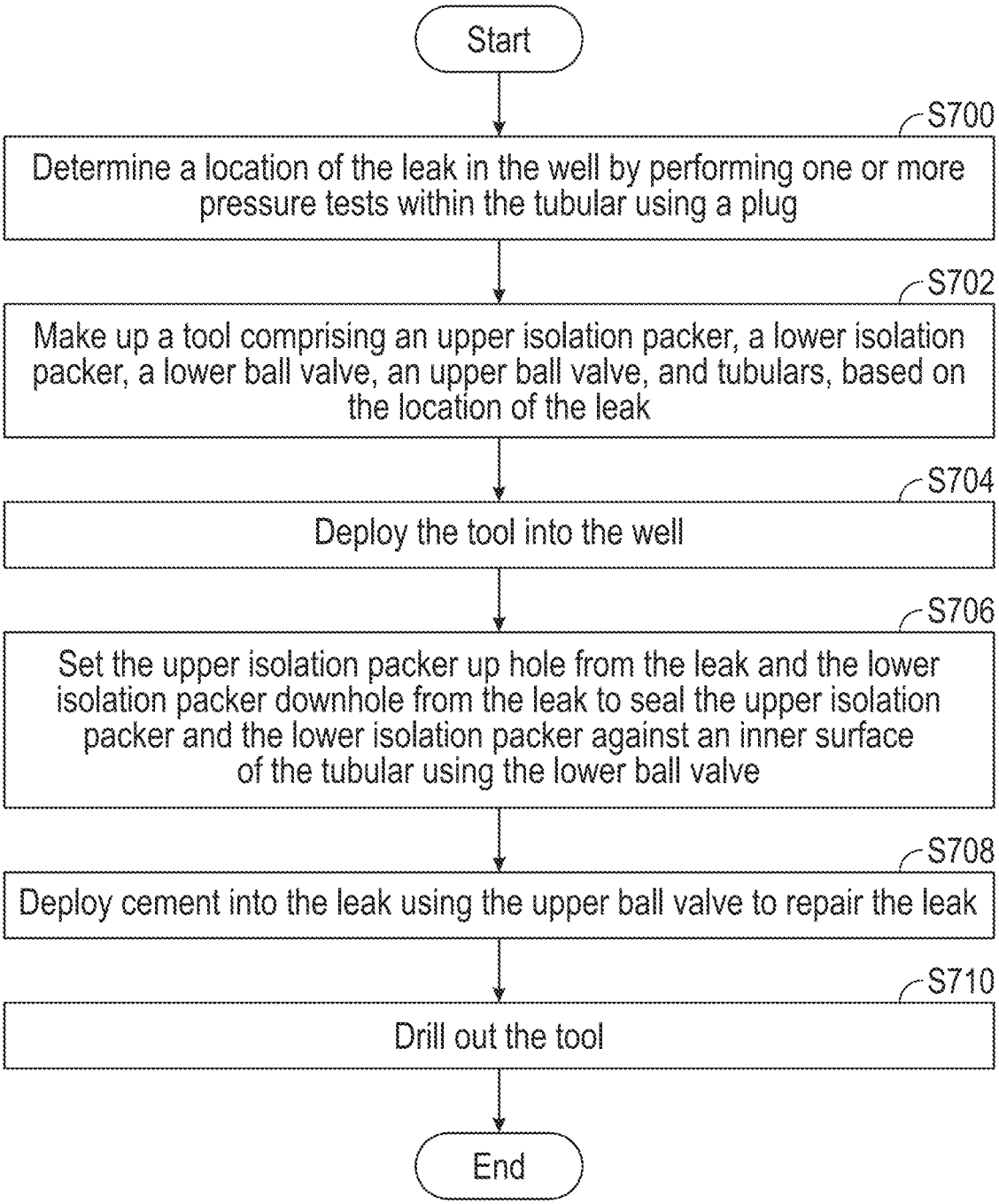
FIG. 7 shows a flowchart in accordance with one or more embodiments.

FIG. 7 shows a flowchart in accordance with one or more embodiments. The flowchart outlines a method for repairing a leak (102) in a tubular located in well (100). While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In S700, a location of the leak (102) in the well (100) is determined by performing one or more pressure tests within the tubular using a plug (200). In accordance with one or more embodiments, the tubular may any tubular deployed in the well (100), such as the production casing string (104). The plug (200) may be deployed into the tubular using drill pipe (208). In accordance with one or more embodiments, the plug (200) comprises slips (206) and a plug packer (204). The slips (206) engage into the inner surface of the tubular and the plug packer (204) seals against the inner surface of the tubular.

Once the slips (206) are engaged and the plug packer (204) is sealed, a pressure test may be performed by pumping a fluid into the tubular using the drill pipe (208) and the plug (200). Because of the plug packer (204) sealing against the inner surface of the tubular, pressure should build beneath the plug (200) because the fluid has nowhere to migrate. However, if there is a leak (102) beneath the plug (200), then the pressure will fail to build, or will not build to the pre-determined value. As such, the pressure test may be performed at various intervals until it can be determined where the leak (102) is located in the well (100). As part of S700, a length of the leak may also be determined.

In S702, a tool comprising an upper isolation packer (302), a lower isolation packer (306), a lower ball valve (308), an upper ball valve (304), and drillable tubulars (310) is made up based on the location of the leak (102). In accordance with one or more embodiments, the tool is the CCLT (300) described above.

After diagnosing and specifying the upper and lower limits of the leak (102) using the plug (200), the upper isolation packer (302) and the lower isolation packer (306) are linked to one other by the drillable tubulars (310) and are spaced out based on the leak (102) interval. The upper ball valve (304) is located along the drillable tubular (310) between the upper isolation packer (302) and the lower isolation packer (306). The lower ball valve (308) is located along one or more drillable tubulars (310) downhole from the lower isolation packer (306).

In S704, the tool is deployed in the well (100). Specifically, the upper isolation packer (302) is located up hole from the leak (102) and the lower isolation packer (306) is located downhole from the leak (102). The CCLT (300) may be deployed in the well (100) using either drill pipe (208) or drillable tubulars (310). The drill pipe (208) or drillable tubulars (310) may be connected to the upper isolation packer (302) of the CCLT (300) using a cement stinger (314). Specifically, the cement stinger (314) may be stung into a sliding valve (312)/disconnect sub in the upper isolation packer (302).

In S706, the upper isolation packer (302) is set up hole from the leak (102) and the lower isolation packer (306) is set downhole from the leak (102) to seal the upper isolation packer (302) and the lower isolation packer (306) against an inner surface of the tubular using the lower ball valve (308).

In accordance with one or more embodiments, the upper isolation packer (302) and the lower isolation packer (306) are set by dropping a lower ball (404) into a lower ball valve conduit (400) to land on a lower ball seat (402) in the lower ball valve (308). A pre-determined pressure is applied on the lower ball (404) landed out in the lower ball seat (402) to activate the upper isolation packer (302) and the lower isolation packer (306) to seal against the inner surface of the tubular.

In accordance with one or more embodiments, the pre-determined pressure may be applied by pumping fluid into the CCLT (300) from the surface (112). Specifically, the fluid being pumped into the CCLT (300) will accumulate on top of the lower ball (404) landed out in the lower ball seat (402). In other embodiments, the fluid in continuously pumped into the CCLT (300) to pump the lower ball (404) into the lower ball valve (308) and the pressure will begin to accumulate once the lower ball (404) lands out in the lower ball seat (402).

The fluid may be pumped into the CCLT (300) until the surface pressure reaches the pre-determined pressure, e.g., 1000 psi. Once the pre-determined pressure is reached, the upper isolation packer (302) and the lower isolation packer (306) will activate and seal against the interior surface of the tubular.

In S708, cement (600) is deployed into the leak (102) using the upper ball valve (304) to repair the leak (102). Specifically, cement (600) is pumped from the surface (112), into an upper ball valve conduit (506) of the upper ball valve (304), and into the leak (102) using circulating ports (502) machined into the wall of the upper ball valve (304).

In accordance with one or more embodiments, the upper ball valve (304) includes a sliding sleeve (500), which has an upper position and a lower position. When the sliding sleeve (500) is in the upper position, the sliding sleeve (500) is blocking the circulating ports (502) located in the upper ball valve (304). When the sliding sleeve (500) is in the lower position, the circulating ports (502) are uncovered.

In accordance with one or more embodiments, the sliding sleeve (500) is held in the upper position using one or more shear pins (504). The sliding sleeve (500) is able to move to the lower position when the shear pins (504) are sheared by a pre-determined pressure. In accordance with one or more embodiments, the pre-determined pressure used to shear the shear pins (504) is larger than the pre-determined pressure used to activate the upper isolation packer (302) and the lower isolation packer (306), such as 1400 psi.

The pre-determined pressure is applied to the shear pins (504) by dropping an upper ball (512) into the upper ball valve conduit (506) to land on an upper ball seat (510) of the upper ball valve (304). In accordance with one or more embodiments, the upper ball (512) has an outer diameter larger than the outer diameter of the lower ball (404). This allows the lower ball (404) to pass through the upper ball seat (510) to access the lower ball valve (308).

Once the upper ball (512) is landed out into the upper ball seat (510), a fluid may then be pumped into the CCLT (300). In other embodiments, the fluid in continuously pumped into the CCLT (300) to pump the upper ball (512) into the upper ball valve (304) and the pressure will begin to accumulate once the upper ball (512) lands out in the upper ball seat (510). Pressure will accumulate on top of the upper ball (512) until the pre-determined pressure is reached. At this point, the shear pins (504) will shear, and the sliding sleeve (500) will be pushed in a downhole direction to uncover the circulating ports (502). The sliding sleeve (500) may be held in this position (the lower position) using a lock mechanism (508).

Once the circulating ports (502) are uncovered, fluid communication may exist between the interior of the CCLT (300) and the section of the interior of the tubular located between the upper isolation packer (302) and the lower isolation packer (306). Thus, cement (600) is able to be pumped from the surface (112), into the CCLT (300), into the interior of the tubular, and into the leak (102). Prior to pumping cement (600), an injectivity test may be performed to calculate the required amount of cement (600) and the lock-up/pre-determined pressure required for the cement operation.

After the injectivity test is performed, the cement (600) may be pumped from the surface (112), through the drill pipe (208) or drillable tubulars (310), through the cement stinger (314), through the upper isolation packer (302), through the drillable tubular(s) (310) connecting the upper isolation packer (302) to the upper ball valve (304), into the upper ball valve (304), out the circulating ports (502) of the upper ball valve (304), and into the interior of the tubular. Once the cement (600) is in the interior of the tubular, the cement (600) will accumulate, and the sealing aspect of the upper isolation packer (302) and the lower isolation packer (306) causes the cement (600) to "squeeze" into the leak (102).

The cement (600) is squeezed into the leak (102) until the lock-up/pre-determined pressure is reached. Once this pressure is reached, the cement stinger (314) may be removed from the upper isolation packer (302) by pulling up on the drill pipe (208) or drillable tubulars (310) that are connected to the cement stinger (314). The cement stinger (314) may be removed from the well (100) to allow the cement (600) to set. The time required to allow the cement (600) to set may be called the "waiting on cement" time.

In S710, the tool is drilled out. In accordance with one or more embodiments, after the required "waiting on cement" time has passed, a drilling assembly/drill string may be picked up and run in the tubular to drill out the portion of the CCLT (300) located up hole from the lower isolation packer (306).

At this point, a pressure test may be performed to determine if the leak (102) has been repaired. If the leak (102) is repaired, the remainder of the CCLT (300) may be drilled out. If the leak (102) has not been repaired, then a new upper isolation packer and some version of a cement circulation valve may be run into the well (100) to perform a subsequent remedial cementing operation.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A system for repairing a leak in a tubular located in a well, the system comprising:

a plug configured to perform one or more pressure tests within the tubular to determine a location of the leak; and a tool comprising:

an upper isolation packer located uphole from the location of the leak and configured to, when subjected to a first pre-determined pressure, seal against an inner surface of the tubular;

a lower isolation packer located downhole from the location of the leak and configured to, when subjected to the first pre-determined pressure, seal against the inner surface of the tubular;

a lower ball valve located downhole from the lower isolation packer;

an upper ball valve located between the upper isolation packer and the lower isolation packer, the upper ball valve comprising circulating ports, the upper ball valve configured to, when subjected to a second pre-determined pressure:

uncover the circulating ports, and deploy cement into the leak through the uncovered circulating ports to repair the leak, wherein the second pre-determined pressure is greater than the first pre-determined pressure; and drillable tubulars connecting the upper isolation packer, the lower isolation packer, the lower ball valve, and the upper ball valve to one another, wherein the drillable tubulars, the upper isolation packer, the lower isolation packer, the lower ball valve, and the upper ball valve are made of drillable material, wherein the tool is configured to:

allow a lower ball to be dropped into the lower ball valve;

increase a pressure uphole from the lower ball to reach the first predetermined pressure, causing the upper isolation packer and the lower isolation packer to seal, without uncovering the circulating ports;

allow an upper ball to be dropped into the upper ball valve below the circulating ports when the upper isolation packer and the lower isolation packer are sealed; and increase the pressure uphole from the upper ball to reach the second predetermined pressure, causing the circulation ports to be uncovered and the cement to be deployed.

2. The system of claim 1, wherein the plug is deployed into the tubular using drill pipe configured to pump a fluid into the tubular through the plug and the plug comprises a packer configured to expand to seal against the inner surface of the tubular and slips configured to engage with the inner surface of the tubular.

3. The system of claim 1, wherein the upper isolation packer comprises a sliding valve configured to receive a cement stinger configured to pump cement to the upper ball valve.

4. The system of claim 1, wherein the lower ball valve comprises a lower ball seat and a lower ball valve conduit.

5. The system of claim 4, wherein the lower ball is configured to be dropped into the lower ball valve conduit, land on the lower ball seat, and block the lower ball valve conduit.

6. The system of claim 5, wherein increasing the pressure uphole from the lower ball comprises pumping a fluid from a surface onto the lower ball landed out in the lower ball seat.

7. The system of claim 1, wherein the upper ball valve further comprises a sliding sleeve an upper ball seat, and an upper ball valve conduit.

8. The system of claim 7, wherein the upper ball is configured to be dropped into the upper ball valve conduit, land on the upper ball seat, and block the upper ball valve conduit, wherein increasing the pressure uphole from the upper ball comprises pumping a fluid from the surface onto the upper ball landed on the upper ball seat.

9. The system of claim 8, wherein the sliding sleeve has an upper position where the sliding sleeve is blocking the circulating ports, and the sliding sleeve has a lower position where the circulating ports are uncovered, wherein uncovering the circulating ports comprises moving the sliding sleeve from the upper position to the lower position.

10. The system of claim 9, wherein:

the sliding sleeve is held in the upper position using shear pins and the shear pins are configured to shear to place the sliding sleeve in the lower position when the second pre-determined pressure is applied on the shear pins, and applying the second pre-determined pressure on the shear pins comprises increasing the pressure uphole from the upper ball to reach the second predetermined pressure.

11. A method for repairing a leak in a tubular located in a well, the method comprising:

determining a location of the leak in the well by performing one or more pressure tests within the tubular using a plug;

making up a tool based on the location of the leak, the tool comprising:

an upper isolation packer located uphole from the location of the leak and configured to, when subjected to a first pre-determined pressure, seal against an inner surface of the tubular;

a lower isolation packer located downhole from the location of the leak and configured to, when subjected to the first pre-determined pressure, seal against the inner surface of the tubular;

a lower ball valve located downhole from the lower isolation packer;

an upper ball valve located between the upper isolation packer and the lower isolation packer, the upper ball valve comprising circulating ports, the upper ball valve configured to, when subjected to a second pre-determined pressure:

uncover the circulating ports, and deploy cement into the leak through the uncovered circulating ports to repair the leak, wherein the second pre-determined pressure is greater than the first pre-determined pressure; and drillable tubulars connecting the upper isolation packer, the lower isolation packer, the lower ball valve, and the upper ball valve to one another, wherein the drillable tubulars, the upper isolation packer, the lower isolation packer, the lower ball valve, and the upper ball valve are made of drillable material, dropping a lower ball into the lower ball valve;

increasing a pressure uphole from the lower ball to reach the first predetermined pressure, causing the upper isolation packer and the lower isolation packer to seal, without uncovering the circulating ports;

dropping an upper ball into the upper ball valve below the circulating ports when the upper isolation packer and the lower isolation packer are sealed;

increasing the pressure uphole from the upper ball to reach the second predetermined pressure, causing the circulation ports to be uncovered and the cement to be deployed; and drilling out the tool.

12. The method of claim 11, wherein the plug further comprises slips and a packer and determining the location of the leak in the well further comprises lowering the plug into the tubular using drill pipe, engaging the slips into the inner surface of the tubular, expanding the packer to seal against the inner surface of the tubular, and pumping a fluid into the tubular via the drill pipe and the plug.

13. The method of claim 11, wherein dropping the lower ball into the lower ball valve comprises dropping the lower ball into a lower ball valve conduit of the lower ball valve to land on a lower ball seat in the lower ball valve.

14. The method of claim 13, wherein increasing the pressure uphole from the lower ball comprises applying the first pre-determined pressure, using fluid, on the lower ball landed out in the lower ball seat.

15. The method of claim 11, wherein the upper ball valve further comprises a sliding sleeve, wherein uncovering the circulating ports comprises moving the sliding sleeve from an upper position where the sliding sleeve is blocking the circulating ports to a lower position where the circulating ports are uncovered.

16. The method of claim 15, wherein moving the sliding sleeve from the upper position to the lower position comprises shearing shear pins holding the sliding sleeve in the upper position.

17. The method of claim 16, wherein dropping the upper ball into the upper ball valve comprises dropping the upper ball into an upper ball valve conduit of the upper ball valve to land on an upper ball seat of the upper ball valve, wherein increasing the pressure uphole from the upper ball comprises pumping fluid from the surface onto the upper ball landed on the upper ball seat.

18. The method of claim 17, wherein shearing the shear pins comprises applying the second pre-determined pressure on the shear pins by increasing the pressure uphole from the upper ball to reach the second predetermined pressure.

19. The method of claim 18, wherein moving the sliding sleeve from the upper position to the lower position comprises pushing the sliding sleeve into the lower position using the second pre-determined pressure once the shear pins are sheared to uncover the circulating ports.

20. The method of claim 19, wherein deploying the cement into the leak further comprises stinging a cement stinger into a sliding valve of the upper isolation packer and deploying cement from the cement stinger, into the upper ball valve, through the circulating ports, and into the leak.

* * * * *